United States Patent [19]

Outlaw

[11] Patent Number: 4,464,906

[45] Date of Patent: Aug. 14, 1984

[54] METHODS AND APPARATUS FOR DRYING FINGERNAILS

[75] Inventor: Joyce Outlaw, Houston, Tex.

[73] Assignee: J J Enterprises Inc., International, Houston, Tex.

[21] Appl. No.: 394,116

[22] Filed: Jul. 1, 1982

[51] Int. Cl.[3] ..... F25D 17/06

[52] U.S. Cl. ..... 62/93; 34/202; 62/404; 62/440

[58] Field of Search ..... 62/93, 94, 404, 440; 34/202, 243 R

[56] References Cited

U.S. PATENT DOCUMENTS

| | | | |
|---|---|---|---|
| 2,184,858 | 12/1939 | Goodman | 34/202 |
| 2,262,274 | 11/1941 | Fingerlin | 34/202 |
| 2,389,822 | 11/1945 | Simmons | 34/202 |
| 2,673,402 | 3/1954 | Chambers | 34/202 |
| 3,367,120 | 2/1968 | Franklin | 62/93 |
| 3,378,009 | 4/1968 | Peplin | 34/202 |

*Primary Examiner*—Ronald C. Capossela
*Attorney, Agent, or Firm*—Carwell & Helmreich

[57] ABSTRACT

Improved methods and apparatus are provided for drying polish or brightener applied to fingernails. A compact housing is provided with an opening for receiving the hand of the user, and a thermoelectric refrigeration unit is provided within the housing for cooling the air below ambient temperature. Air is recirculated by a fan in a portion of the housing, and a deflector directs the cool air away from the opening and onto the fingernails.

20 Claims, 6 Drawing Figures

METHODS AND APPARATUS FOR DRYING FINGERNAILS

BACKGROUND OF THE INVENTION

The present invention relates to methods and apparatus for the care and adornment of fingernails, and particularly, to methods and apparatus for drying polish applied to fingernails.

Many manicurists do not utilize apparatus to assist in drying fingernails after a polish or brightener has been applied. As a result, customers typically can be found in a sitting area, perhaps waving their hands back and forth, waiting for their fingernails to dry before leaving the salon. The customer normally cannot resume conventional seditary activities, such as reading, before the nails dry. Frequently, the customer's desire to do something productive prevails over the warnings of the manicurist, and the carefully applied polish becomes damages because the "wet" nail contacts clothes or papers. As a result, the damaged nail must be redone, and still more time spend waiting for the nail polish to dry.

Devices are available to assist the manicurist in applying the correct tint or shade of polish to the nails through proper lighting techniques, such as devices shown in French Pat. No. 1,005,277 and U.S. Pat. No. 3,478,763. Suitable methods and apparatus satisfactory to both the manicurist and the customer, however, do not exist for drying the nails after the nail polish has been applied. Customers have been known to use conventional washroom hand devices (U.S. Pat. Nos. 2,698,804 and 2,714,151), hair dryers (U.S. Pat. No. 2,496,232) and hair blowers (U.S. Pat. No. 2,713,627) to assist in drying nails. These devices, however, are not intended to dry fingernails, and frequently the customer will damage the nails by attempting to use the device rather than shortening the drying time for the nails.

Prior art devices specifically intended to dry one's fingernails have previously been devised, but have not been widely accepted. Such devices are frequently extremely complicated and inefficient, and do not reduce the drying time for nails to any appreciable extent. U.S. Pat. No. 3,258,853 discloses a complicated nail dryer which uses heated air to assist at drying nails. U.S. Pat. Nos. 3,712,312 and 4,206,556 disclose more simplistic nail drying apparatus, wherein heated air is discharged from the device toward the nails of the user. Finally, U.S. Pat. No. 4,255,871 discloses a nail polish dryer with a plurality of exit ports for directing the drying air against the nails of the user. Such devices, however, are inefficient for drying one's nails, and thus have not been widely accepted by the manicurist or the customer.

The disadvantages of the prior art are overcome by the present invention, however, and improved methods and apparatus are hereinafter provided for drying the polish applied to fingernails.

SUMMARY OF THE INVENTION

A housing is provided having an opening for receiving the hand of the user. An electric motor rotates one or more fans, which circulate air through the housing. A thermoelectric refrigeration unit cools a portion of the circulated air, and a deflector directs the cooled air toward the fingernails and generally away from the wrist of the user, thus minimizing cool air loss through the opening. A cool air return duct is provided, so that the cool air is recirculated within the housing.

According to the method of the present invention, the thermoelectric unit is energized to begin cooling aluminum fins on the cool side of the thermoelectric unit, and air may be circulated across similar fins on the warm side of the unit. Subsequently, the fan is energized for circulating air across the cool air side of the thermoelectric unit, and the cool air is directed toward the fingernails of the user. The cool air temperature is maintained within selected limits since the refrigeration unit is responsive to a signal from a temperature sensor within the housing.

It is a primary feature of the present invention to provide apparatus for drying fingernails with air below ambient temperature.

It is another feature of the present invention to provide improved apparatus for drying fingernails more rapidly than prior art apparatus.

Still another feature of the present invention is to provide compact apparatus for drying fingernails comprising a refrigeration unit.

It is a further feature of the present invention to provide recirculating cool air within a preselected temperature range to fingernails.

Other and further objects, advantages, and features will become apparent from the following detailed description, wherein reference is made to the figures in the accompanying drawings.

IN THE DRAWINGS

DETAILED DESCRIPTION

According to the present invention, improved methods and apparatus are provided for drying the polish applied to fingernails. As used herein, the term polish encompasses various liquids generally applied to the fingernails by an individual or manicurist, including base materials for the polish, nail hardeners, polish protectors, cuticle softeners and removers, etc. Each of these materials is in liquid form when applied to the nails, and the nail is therefore "wet" until the liquid has dried or hardened to the extent that it can no longer be removed by merely touching the nail against an object. It will be understood that the phrase "drying the fingernails" as used herein means drying the polish on the fingernails.

The present invention involves the use of cool air to dry the polish on the fingernails, i.e., air cooled below room or ambient temperature. It has been found that such cool air dries polish more quickly than warm air or room temperature air, and compact apparatus suitable for use at one's home or manicurist's shop is herein provided for both cooling air and directing the cool air onto the fingernails of the user.

Figure 1:
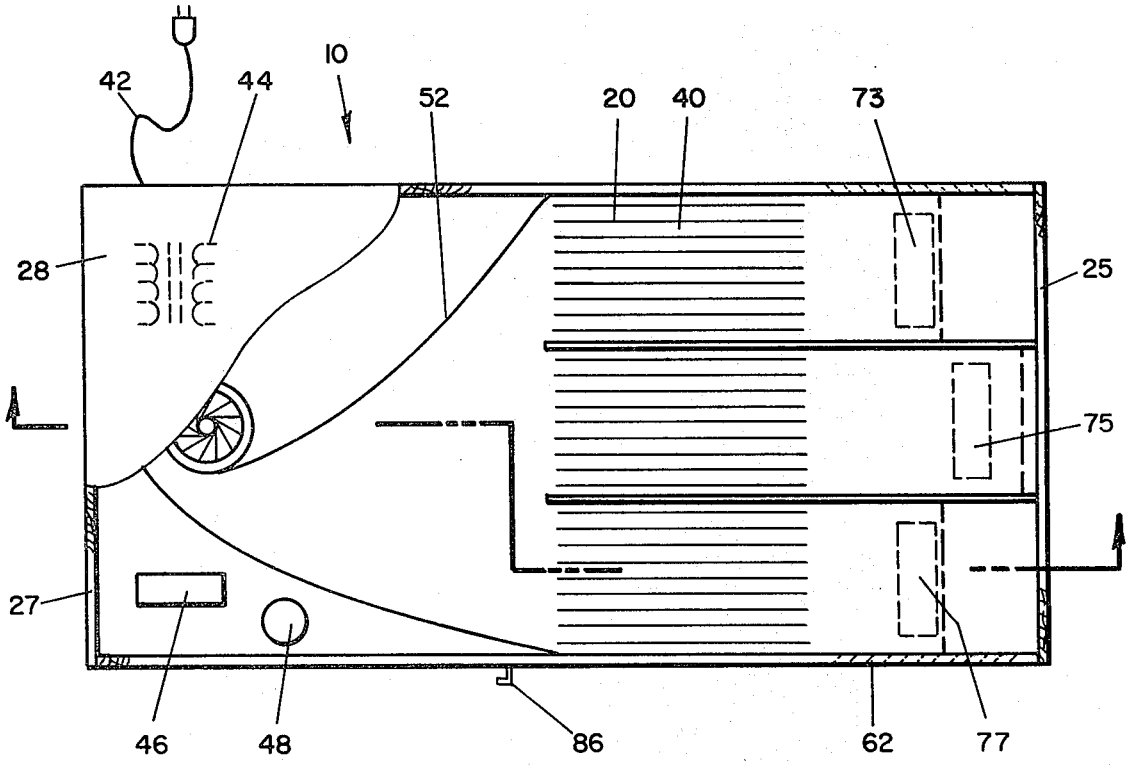
FIG. 1 is a top view of one embodiment of the present invention with a portion of the cover removed.
Figure 2:
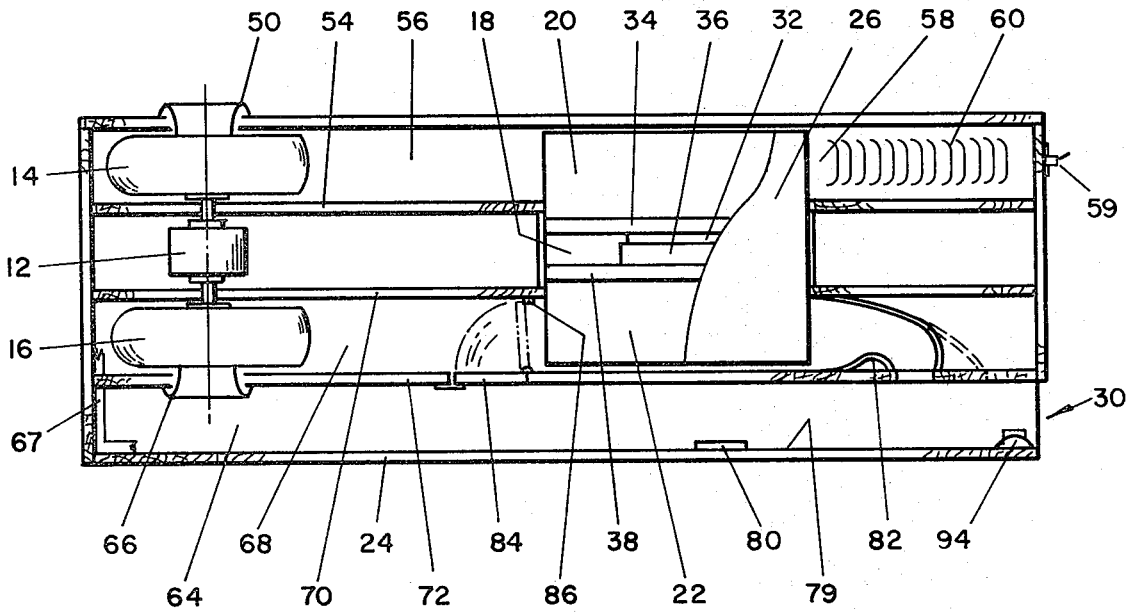
FIG. 2 is a cross-sectional side view of the embodiment shown in FIG. 1.

As shown in FIGS. 1 and 2, a housing 10 is provided for accommodating a motor 12, one or more blowers or fans 14 and 16, a refrigeration unit 18, warm air transfer fins 20, and cool air transfer fins 22. The housing 10 includes a base 24, two sidewalls 26, a front wall 25, a back wall 27, and a cover 28, each of which may be formed of suitable construction material, such as wood or metal. An opening 30 is provided in the front wall of the housing 10 for insertion of the user's hands. The housing 10 and portions within the housing form air ducts, which will be described below.

The thermoelectric refrigeration unit 18 of the present invention is of the type employing a Peltier element. The element 32 may be supplied with DC electrical power from leads (not shown). The element 32 warms heat sink 34 above ambient temperature, and cools block 36 and heat sink 38 below ambient temperature. Heat is then conducted from heat sink 34 to a plurality of aluminum transfer fins 20. As shown in FIG. 1, the transfer fins are basically thin plates vertically positioned so that air may pass through gaps 40 between adjacent plates. Similarly, the heat sink 38 is cooled below ambient temperature, as are the connected cool air transfer fins 22. The cool air transfer fins may be substantially identical to the ones previously described, and cool the air between the fins below ambient temperature. A suitable thermoelectric unit is sold by Materials Electronic Products Corporation of Trenton, N.J., part no. CPI4-127-06L. If desired, one or more thermoelectric units and corresponding transfer fins may be used in parallel or in series according to the present invention. For instance, FIG. 1 shows the transfer fins of three such thermoelectric units in parallel.

The thermoelectric unit may be powered from a DC power source, while the motor 12 may be either AC or DC powered. Accordingly, it should be understood that 110 volt AC power may be supplied to the motor 12 and transformer 44 from a conventional power supply cord 32. A transformer 44 may be employed to reduce the AC voltage to a suitable level, such as 36 volts. AC power from the transformer 44 may then be rectified by rectifier 46 and filtered by capacitier 48, so that continuous DC power may be supplied to the thermoelectric unit.

The motor 12 drives warm air centrifical fan 14, thereby drawing room air or ambient air through entrance shroud 50 and discharging air through exhaust ducting 52. The substantially horizontal interior floor portion 54, the top 28, and the substantially vertical ducting 52 thus form an air passageway 56 which delivers room air evenly across the heat transfer fins 20. The air continues to pass through the gaps 40 between the heat transfer fins, thereby removing heat generated by the Peltier element. Upon leaving the transfer fins, the warm air enters chamber 58 formed by the floor portion 54, the top 28, the side walls 26, and the front wall 25 of the housing. Air may exit the chamber 58 through exit slot 60 provided on each side of the sidewalls of the housings. To prevent warm air from contacting the user, deflectors or louvers 62 may be provided in the exit slots, which will direct the air toward the back end of the housing.

The cool air side of the apparatus is preferably a substantially closed loop system, i.e., most of the cool air directed toward the fingernails is recycled through the apparatus, thus improving the efficiency of the apparatus and reducing the costs of the refrigeration unit. As previously noted, an opening 30 is provided for receiving the hands of the user. Thus, the cool air ducting, even when the hands are in place, is not completely sealed. As described below, however, Applicant does utilize a substantially closed loop cool air system so that at least 90%, and preferably at least 95%, of the air volume discharged from the fan 16 returns to the fan and is recycled through the system.

The motor 12 rotates cool air centrifugal fan 16, thereby drawing air from the return cool air chamber 64 and through entrance shroud 66 of the fan 16. The air is discharged through substantially vertical discharge ducting similar to ducting 52, and a discharge chamber 68 is formed by the substantially vertical ducting and the interior floor portions 70 and 72. Air is thus uniformly passed through the cool air transfer fins 22 in a manner similar to that described for the warm air fins, thereby cooling the air.

Figure 3:
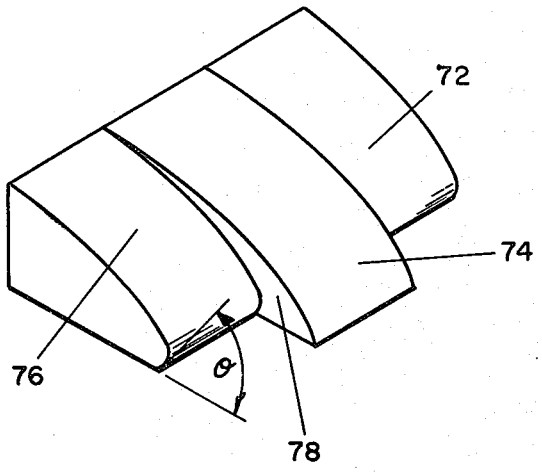
FIG. 3 is an isometric view of a portion of the apparatus depicted in FIGS. 1 and 2.

According to the embodiments shown in FIGS. 1 and 2, air is discharged into one of three cool air ducts, which are also shown isometrically in FIG. 3 as ducts 72, 74 and 76. Duct 72 and 76 each deliver air to the nails on the fingers of a hand, by discharging the air through exit slots 73 and 77, respectively, as shown in FIG. 1. Duct 74 is intended to deliver air to the nails on both thumbs, and discharges air through exit slot 75, which is spaced closer to the opening 30 than slot 73 and 77.

Substantially vertical walls 78 may be provided between the ducts 72, 74 and 76, so that with the sidewalls 26 of the housing, three separate air flow chambers are provided. As shown in FIGS. 2 and 3, the ducting directs the cool air away from the opening 30 and toward the location of the fingernails. Preferably, at least each of the ducts 72 and 76 engages the floor portion 72 at the front portion of its respective exit slot at an angle $\theta$ less than 90°, and preferably between 50° and 80° with respect to a horizontal plane forward of the exit slot. Thus, the ducting is particularly suited to create a substantially closed loop cool air system. The ducting 78 for the thumbs also could be formed at the same angle with respect to the substantially horizontal portion 72, although less air will generally exit slot 75 than slots 73 and 77. More particularly, and within limits of ±5%, it is desirable that 40% of the cool air exit each of the slots 73 and 77, and that 20% of the cool air exit slot 75. If desired, a curved duct 82 raised from the portion 72 may be provided on the upstream side or back side of the exit slots, which will assist in deflecting air away from the opening 30.

Air is discharged onto the fingernails of the hand, and into the cool air return chamber 64 formed by the sidewalls 26, the portion 72, and the base 24. The cool air may be drawn past a temperature sensor 80, which sends a signal to the thermoelectric unit 18 indicative of the cool air temperature. For instance, if the desired air temperature at sensor 80 would be 55° F., the sensor 80 may forward a command signal to the thermoelectric unit 26 indicative of a cool air temperature greater than or equal to 55° F. If the air temperature drops below 55°, however, the sensor 80 may send another signal which will temporarily terminate or reduce the DC power to the thermoelectric unit 26. After a preselected period of time or in response to another signal from the sensor 80 indicative of a detected temperature greater than 55°, full DC power may be restored to the unit 26.

It may be desirable to pass air through the transfer fins 20 to remove heat from the element 32 while allowing the fins 22 to cool to a desired temperature level before passing air through the fins 22. In the embodiment shown in FIG. 2, a single motor drives both fans 14 and 16. A hinged plate 84 may be provided for a portion of the substantially horizontal floor portion 72, and a handle 86 exiting the side of the apparatus may be used to raise the plate 84 to a substantially vertical position against stop 86. When raised, the plate 84 prohibits air from passing through the lower cool air transfer fins, and air is simply recirculated by the fan 16 through chamber 68 and a portion of a chamber 64. After a desired period of time or after the temperature of the fins 22 reaches a preselected temperature, a signal light (not shown) may be energized, and the operator may return plate 84 to its horizontal position. Because the sensor 80 is immediately downstream of the fingernails, the air temperature at 80 will be approximately equal to the temperature of the air injected against the nails. The air temperature onto the fingernails will generally be maintained between 45° F. and 65° F., and preferably between 50° F. and 60° F., to provide rapid drying of the polish without discomfort to the user.

The air volume moved by the warm air fan 14 should be sufficient to keep the efficiency of the element 32 high. For the embodiment described in FIGS. 1 and 2, fan 14 preferably delivers at least 90 CFM through the fins 20. The air volume to the cool air fins 22 is preferably controlled within fixed limits. A sufficient air movement should be provided to continually pass a fresh supply of cool air pass the nails, but too much air may cause the polish on the nails to "run" and may be a discomfort to the user. The volume of air delivered by the cool air fan 16 will generally be between 40 CFM and 100 CFM, and preferably between 50 CFM and 70 CFM, so that the nails are rapidly dried without any detrimental effects.

Figure 4:
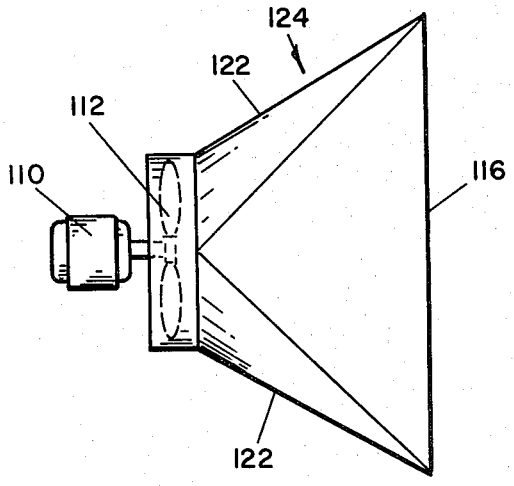
FIG. 4 is a top view of a portion of the cool air ducting a another embodiment of the present invention.
Figure 5:
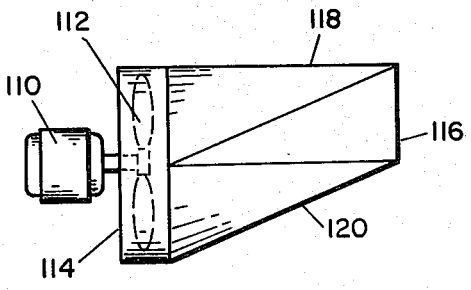
FIG. 5 is a side view of the portion of the ducting shown in FIG. 4.

FIG. 4 is a top view of another embodiment of a portion of the cool air ducting shown in FIG. 2; FIG. 5 is a side view of the portion of the ducting shown in FIG. 4. On the cool air side, the centrifugal fan 16 may be replaced by a propeller-type fan 112 with a separate drive motor 110. The axis of the propeller fan 112 will preferably be substantially horizontal. Cool air ducting 124 comprises a cylindrical-shaped entrance portion 114 for the propeller fan 112, and expands upward and outwardly to form a rectangular-shaped exit portion 116 for accommodating the ducting shape just prior to the cool air fin 22. The cool air ducting shown in FIGS. 4 and 5 thus comprise a substantially horizontal portion 118, a portion 120 sloping upward, and two side portions 122. Ducting 124 provides sufficient vertical spacing for the propeller-type fan 112 while also providing for recirculation of the cool air. Roof portion 120 slopes up to meet the portion 72, and tapers out to the width of the fins 22. Air from the cool air return duct 64 may thus pass under the roof portion 120 and around the side portions 122 and enter the back side of the propeller fan 112. Air will be discharged from the propeller fan and across the fins 22, as previously described. The substantially vertical sidewalls 122 prevent the return air from pre-mixing with the air discharged from the propeller-type fan. Although a similar propeller fan driven by its own drive motor may also be provided for the warm air ducting, the warm air ducting may be simplified since no warm air recirculation is necessary.

Figure 6:
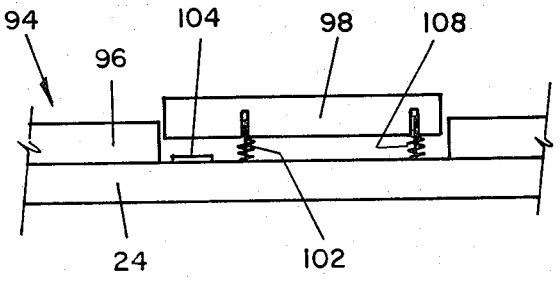
FIG. 6 is an expanded view of the cool air barrier shown in FIG. 2.

FIG. 6 is an expanded side view of a portion of the vertical air barrier 94 shown in FIG. 2. The air barrier 94 is mounted to the base 24, and includes an elongate stationary portion 96. The top of the air barrier 96 is sufficient to prohibit a layer of cool air just above the base 24 from discharging through opening 30. Riser 96 may be formed from wood, plastic, or cloth, and preferably is ¼" to 1" high above the base 24. The air barrier may be rectangular, or may be semi-circular in cross-section, with the flat side mounted to be the base.

Although all of the riser 94 across the opening 30 may be stationary, it is also a feature of the present invention to provide a movable portion 98 which functions both as a riser and a portion of an on/off switch. Portion 98 may be placed across the opening for activation by one or both of the wrists of the user, and may be mounted to two pegs 102 and biased in the upward position by a pair of springs 108. The weight of the base of the hand or the wrist of the user may thus force portion 98 downward into engagement with contact 104, thereby causing activation of either the motor 12 or thermoelectric unit 32, or both.

The operation of the embodiments shown in FIGS. 1 and 2 will now be described in further detail. When the polish has been applied to the nails of the user, an activation switch 59 on the front of the apparatus (depicted in FIG. 2) may be turned on to activate the refrigeration unit 18 and the drive motor for fan 14. When both the warm air fan 14 and the cool air fan 16 are energized by the same motor, it will be understood that plate 84 may previously have been raised to the substantially vertical position against stop 86. When the cool air fins 22 are within a desired temperature range, or after a preselected period of time, a light (not shown) may become energized to inform the user that the device is ready for operation. The user may then lower portion 84 to its substantially horizontal position. Thereafter, the user may insert his or her hands through the opening 30. In the embodiment with two fan drive motors, the weight of the base of the hand may depress the movable portion 98 to cause activation of the drive motor for the cool air fan 16. Alternatively, the cool air fan drive motor may be energized my moving the multi-position switch 95 to the "cool air" position. Air will thus be forced across the fins 20 and out the exit ports 60 and away from the user. Simultaneously, cool air will be forced across the fins 22 and be deflected into engagement with the nails and recirculated through the cool air system.

Although a thermoelectric refrigeration unit is particularly suitable for use according to the present invention, it will be understood that the invention is not to be limited to a thermoelectric refrigeration unit, and that any compact refrigeration unit may be used according to the concepts of the present invention. For instance, cool air could also be generated using the Hilsh vortex. In this case, the compressed air may be supplied to the vortex and separated into cool air and warm air by the vortex, and the cool air discharged onto the fingernails and returned to the intake for the air compressor. Also, the compressor may function as blower means for moving air within the housing, so that a separate fan and fan motor may not be required.

Although the present invention has been described with respect to drying polish on the fingernails of the user, it will be understood that the invention is not limited to drying polish on fingernails, and the concepts of the present invention are equally applicable to drying polish applied to the toenails of the user.

The housing 10 may be fabricated of wood, metal, or other suitable construction material. The outer walls of the cool air ducting are preferably insulated to minimize heat gain to the cool air side. A suitable insulation material 67 is shown typically in FIG. 2, and may be asbestos board, styrofoam, or another material suitable for use in the interior or exterior of the air ducts.

The ducting 72, 74 and 76 may be fabricated from sheet metal or sheet plastic. If desired, the ducting shown in FIG. 3 may be molded from plastic as a single unit, which minimizes construction costs.

Any type of fan or blower may be used to move air within the housing. If a propeller-type fan is utilized and it is desired to keep the housing reasonably compact, the cool air ducting as shown in FIGS. 4 and 5 is preferable.

A substantially horizontal surface 79 is provided for the palm of the user. Cool air is thus discharged downwardly onto the fingernails and away from the opening for the hands. Cool air then passes down the cool air return duct and is recirculated by the cool air return fan.

It should be understood that various changes, modifications and variations and the structure and function of the present invention may be affected without departing from the spirit or scope of the present invention as defined in the appended claims. Many possible embodiments may be made of this invention without departing from the spirit and scope of the invention, and it should be understood that all matters herein set forth and shown in the accompanying drawings are to be interpreted as illustrative and not in any limiting sense.

What is claimed is:

1. Apparatus for drying polish applied to fingernails, comprising:
   a housing having an opening for receiving said fingernails;
   a refrigeration unit within said housing for cooling air below room temperature;
   blower means for recirculating cooled air within said housing;
   a cool air supply duct for directing air past said refrigeration unit, toward said fingernails and away from said opening in said housing; and
   a cool air return duct for returning at least a substantial portion of said cooled air directed toward said fingernails to said refrigeration unit.

2. Apparatus as defined in claim 1, wherein said refrigeration unit is a thermoelectric refrigeration unit comprising a Peltier element.

3. Apparatus as defined in claim 1, further comprising:
   air circulating means for removing heat from within said housing.

4. Apparatus as defined in claim 3, further comprising:
   deflector means for directing said heated air away from said opening.

5. Apparatus as defined in claim 3, further comprising:
   an elongate cool air barrier adjacent a lower portion of said opening for retaining cool air within said housing.

6. Apparatus as defined in claim 1, wherein said air ducting further comprises:
   at least three cool air exit slots for discharging cool air generally downward toward said fingernails.

7. Apparatus as defined in claim 6, wherein said air ducting for at least one of said exit slots intersects a front portion of its respective exit slot at an angle between 50° and 80° with respect to a horizontal plane forward of said exit slot.

8. Apparatus as defined in claim 1, further comprising:
   a plurality of warm air heat transfer fins thermally connected to said refrigeration unit for removing heat from said refrigeration unit; and
   a plurality of cool air heat transfer fins thermally connected to said refrigeration unit for cooling recirculating air within said housing.

9. The apparatus as defined in claim 1, further comprising:
   a cool air supply duct barrier for selectively restricting the circulation of air past said refrigeration unit.

10. A method for drying polish applied to fingernails, comprising:
   providing a housing having an opening for receiving said fingernails;
   providing cooling means within said housing for cooling air within at least a portion of said housing below room temperature;
   directing said cooled air toward said fingernails;
   directing at least a substantial portion of said cooled air directed toward said fingernails away from said opening in said housing; and
   returning said at least substantial portion of said cooled air to said cooling means.

11. A method as defined in claim 10, further comprising:
   providing warm air fins within said housing for removing heat from within said housing; and
   providing cool air fins within said housing for cooling recirculating air within said housing.

12. A method as defined in claim 11 further comprising:
   providing a cool air barrier adjacent a lower portion of said opening for retaining said cooled air within said housing.

13. A method as defined in claim 11, further comprising:
   circulating air across said warm air fins; and
   thereafter circulating air across said cool air fins.

14. A method as defined in claim 13, wherein the volume of air circulated across said cool air fins is controlled between 40 CFM and 100 CFM.

15. A method as defined in claim 11, further comprising:
   monitoring the temperature of said cooled air within said housing; and
   regulating further cooling of said air in response to said monitored air temperature.

16. A method as defined in claim 15, wherein the temperature of said recirculated air is controlled within the range of 45° F. to 65° F.

17. A method as defined in claim 10, further comprising:
   selectively restricting the circulation of air past said cooling means.

18. Apparatus for drying polish applied to fingernails, comprising:
   a housing having an opening for receiving said fingernails;
   a refrigeration unit within said housing including the plurality of warm air heat transfer fins and a plurality of cool air heat transfer fins;
   blower means for recirculating cooled air within said housing;
   a cool air supply duct for directing said air past said cool air heat transfer fins and toward said fingernails; and
   a cool air return for returning at least a substantial portion of said cooled air directed toward said fingernails to said refrigeration means.

19. Apparatus as defined in claim 18, wherein said cool air supply duct further comprises:
   at least three cool air exit slots for discharging cool air generally downward toward said fingernails.

20. Apparatus as defined in claim 18, further comprising:
   a cool air supply duct barrier for selectively restricting the circulation of air past said refrigeration unit.

* * * * *